United States Patent [19]

Cacioppo

[11] Patent Number: 5,001,875

[45] Date of Patent: Mar. 26, 1991

[54] PREFABRICATED ROOF STRUCTURE AND SUPPORT FOR BAY AND BOW TYPE WINDOWS

[76] Inventor: Vincent Cacioppo, 24 Frank Ave., S. Farmingdale, N.Y. 11735

[21] Appl. No.: 380,124

[22] Filed: Jul. 14, 1989

[51] Int. Cl.[5] ..... E06B 1/38

[52] U.S. Cl. ..... 52/201

[58] Field of Search ..... 52/201, 74, 73, 37, 52/36; 47/40, 68

[56] References Cited

U.S. PATENT DOCUMENTS

| | | | |
|---|---|---|---|
| D. 240,219 | 6/1976 | Kaneko et al. . | |
| 568,041 | 9/1896 | Quackenboss | 52/201 |
| 2,474,011 | 6/1949 | Overly | 52/74 |
| 2,862,259 | 12/1988 | Rimmeir | 52/74 |
| 3,074,125 | 1/1963 | Miller | 52/201 |
| 3,218,773 | 11/1965 | Heirich | 52/74 |
| 3,429,082 | 2/1969 | Strickland | 52/201 |
| 3,507,079 | 4/1970 | George | 52/74 |
| 4,009,546 | 3/1977 | Buck | 52/201 |
| 4,103,466 | 8/1978 | Nagase | 52/73 |
| 4,132,033 | 1/1979 | Esposito . | |
| 4,439,963 | 4/1984 | Feiss . | |
| 4,643,246 | 2/1987 | Ikemura et al. | 52/201 |

FOREIGN PATENT DOCUMENTS

| | | | |
|---|---|---|---|
| 889406 | 2/1962 | United Kingdom | 52/73 |

*Primary Examiner*—John E. Murtagh

*Attorney, Agent, or Firm*—Dilworth & Barrese

[57] ABSTRACT

A prefabricated roof structure for bay or bow type window assembly. The roof structure includes a cap of unitary construction which covers a rigid infrastructure or frame. The frame is provided with a support ledge which forms an acute angle with the frame body, and a support beam is provided beneath the ledge to form a shoulder which abuts and engages a window frame for securing the frame thereto. A tensioning element such as a support bar, guy wire or cable may be provided to securely anchor the roof structure and window assembly to the wall of a building on which the window assembly is to be installed. The roof structure may be inverted to for a bottom support and cover to securely fasten the window assembly to the wall.

4 Claims, 3 Drawing Sheets

PREFABRICATED ROOF STRUCTURE AND SUPPORT FOR BAY AND BOW TYPE WINDOWS

BACKGROUND OF THE INVENTION

1. Field of the Invention

The present invention relates to roof structures for bay and bow type window assemblies, and in particular, the invention relates to a prefabricated roof structure that may be installed as a complete unit at a construction site which serves as both a roof cover and support for a bay or bow type window assembly.

In the construction of residential buildings such as houses or apartments and condominiums, as well as some commercial buildings such as store fronts or offices, it has become increasingly desirable to install bay and bow type window assemblies in place of conventional windows to provide an increased cosmetic appeal to the structure, and more importantly, to provide added space and natural light to the interior of such a building. Bay windows are well known in the art, and generally comprise a three-frame assembly in which a center frame is flanked by two side frames which angle outwardly from the wall of the building to the center frame, in which the center frame is positioned in parallel relation with the wall. Bow windows are similar to bay windows except that additional frames are provided, and the assembly tends to have a more rounded shape by eliminating the parallel center frame.

These window assemblies are generally assembled onsite during construction and are secured to the wall by a support beam arrangement which anchors the window unit in place. Generally, a decorative weatherproofing cover in the form of a roof is then assembled on the installed window assembly to protect the window assembly against environmental conditions such as rain, snow and the like. However, these covers are decorative only and protect the window assembly from the elements, but do not add to the support of the window assembly in a constructional manner. Accordingly, sound proofing is sometimes necessary to alleviate the noise generated by wind and heavy rain impacting on the roof, especially if the roof is constructed of a plastic or metal material, as is generally the case. Furthermore, many of these roof structures are assembled on-site and tend to increase the labor costs which are of course passed on to the owner of the building, as well as increasing the time required to complete the installation.

In addition, if these known covers are inverted to form the bottom cover to the bay window, they are not capable of providing support for the window assembly, and of course must be installed subsequent to installation of the window, and after the window is fastened in place.

2. Discussion of the Prior Art

In the prior art, several types of roof structures for bay and bow type window assemblies are disclosed. These roof structures generally must be assembled at the construction site prior to or during installation and then located and affixed on the installed window assembly. In addition, it is known in the prior art to provide a prefabricated window assembly having a roof cover integrally constructed with the prefabricated assembly, so that the entire window unit is installed as a single piece. These units generally require that the window frame assembly be firmly anchored to the wall of the building, while the roof structure, and bottom frame structure, if provided, are decorative only and do not add to the support and securement of the window assembly. The roof cover in these window units is provided for cosmetic purposes, and serve only to protect the window from environmental conditions such as rain and snow.

Buck, Jr., U.S. Pat. No. 4,009,546, discloses a preassembled unitary bay window construction which includes a prefabricated roof structure which is constructed of sheet metal sections. The sections are joined along interlocking edge ribs and include a flashing at the upper end for connection to the wall of a building, and a lower inturned horizontal lip which engages a flange of the header of the window assembly. The window and roof are constructed together prior to installation, and are installed as a complete unit. However, structural support for the window assembly is not provided by this roof structure, which is a decorative cover only.

Feiss, U.S. Pat. No. 4,439,963 discloses a bay window roof structure for bay window assemblies which is assembled and installed on-site during construction of the window. The roof is constructed of molded plastic panels which are joined together edge to edge in a predetermined angular relationship conforming to the angles of the vertical window frames. After the bay window assembly is installed, the center panel of the roof structure is positioned on the window assembly and fixed into place. The end or flanker panels are then engaged in a slot provided on the edge of the center panel and secured in place. This roof structure is also a decorative cover, and does not provide for structural support for the window assembly.

SUMMARY OF THE INVENTION

The present invention eliminates or substantially ameliorates the disadvantages encountered in the prior art through the provision of a roof structure and support for bay and bow type window assemblies having a rigid frame or infrastructure covered with a cap of unitary construction, in which the entire roof structure is prefabricated and delivered to a construction site for immediate, quick and efficient installation. The structure is cosmetically appealing and provides a finished appearance to the window construction while at the same time providing additional support and structural stability to the window assembly. In addition, the structure may be inverted to form the bottom cover and support system for the window assembly, thus anchoring and securing the window in an efficient and structurally sound manner.

The novel, prefabricated roof structure and support of the present invention obviates the problems associated with the prior art roof structures by providing an easy to intall unit which is preassembled at the factory and delivered to a job site intact, so as to be positioned in place on a window assembly in a quick and efficient manner. The structure of the present invention is a structurally sound unit which serves to support and anchor the window assembly to the building as either a roof structure or bottom support base and cover.

In a preferred embodiment, a rigid infrastructure or frame is provided which is covered with a lighter decorative cover, which is preferably of unitary construction. The frame is preferably constructed of wood, and includes a support ledge which is located at the lower end of the frame so as to form an acute angle with the frame body. The support ledge forms a shoulder portion in cooperation with a support beam for receiving and engaging the top edge of the window assembly so that the window may be secured to the support ledge. When the roof is installed, the support ledge is substantially perpendicular to the window frame. The cover portion has an upright flange at its upper edge for securement to the wall of the building, and at its lower edge is provided with an inturned lip which turns under the support ledge of the frame to provide a finished appearance.

Preferably, the support ledge is provided with a tensioning device, such as a brace, a cable or guy wire, which is secured to the wall of the building to anchor the roof and window assembly to provide structural stability and support. Depending on the size of the window assembly, and consequently the roof structure, several tensioning devices may be provided to brace and secure the roof structure and window assembly. In addition, when the unit is inverted to form the bottom support brace and cover, a metal brace is provided as a tensioning device to eliminate the need for additional support brackets and frames. The pre-assembled cover serves as a decorative cover while at the same time serving as a structural suspension brace to support and secure the window assembly.

In another embodiment, the frame may be eliminated and a single prefabricated rigid roof structure may be formed from materials such as reinforced plastic, or other nonflexible materials such as metals including stainless and painted steel, copper and the like. In this embodiment, the cover is of unitary construction and is provided at an upper end with an upright flange for securing the roof to the wall, and at the lower edge is provided with an inturned support ledge which forms an acute angle with the panels which form the roof body. The support ledge has a stepped configuration which forms two parallel ledges connected by a perpendicular shoulder which engages and receives the window assembly and secures the window at this point. For added structural support, a tensioning means may be provided at the support ledge for securing the ledge to the wall at several points. Alternately, the support ledge may be provided with a notch or channel for receiving the window assembly.

In use, the window assembly is installed in an opening in a wall of a building and the prefabricated roof structure is then positioned over the window assembly. The shoulder portion of the support ledge abuts the upper edge of the window assembly and the window is then fixedly secured to the roof structure. The flashing provided at the upper edge of the roof structure is then secured to the wall by means of fasteners such as screws, nails, bolts and the like to anchor the roof and window assembly to the building. If added support is required, tensioning means in the form of a cable or guy wire, or preferably, in the form of an angled metal brace, is provided on the support ledge and angles to a location behind the flashing where the flashing meets the wall. The flashing and brace are then anchored to the wall and tightened together so as to connect the support ledge to the wall and firmly anchor the window and roof assembly in place.

When the structure is inverted to form the bottom support and cover, the window platform is secured to the sill plate and leveled. The bottom structure is then put in place an secured to the window platform. The platform is again leveled, and the metal tensioning brace and flashing are then secured to the wall by screws, nails or the like to anchor the window platform. The window assembly is placed on the window platform and secured. The bottom support and cover thus eliminates the need for additional support brackets and frames, and serves as a single unit to be installed as one complete piece.

Accordingly, it is a primary object of the present invention to provide a prefabricated roof structure and support for bay and bow type windows which may be installed in a quick and efficient manner.

It is a further object of the present invention to provide a prefabricated roof structure for bay and bow type windows which adds to the structural integrity of the window assembly and serves to further support and anchor the window assembly to the wall of a building.

It is yet another object of the present invention to provide a prefabricated roof structure for bay and bow type window assemblies having a finished exterior and a structurally sound construction for finishing a bay window or bow window assembly while adding to the structural integrity of such a window.

It is still a further object of the present invention to provide a prefabricated roof structure for a bay or bow type window assembly which protects the window assembly from environmental conditions while at the same time substantially reducing or eliminating transmitted sound without the necessity of additional sound proofing.

It is yet another object of the present invention to provide a prefabricated roof structure for bay and bow type window assemblies which may be inverted for use as a base structure for supporting and anchoring a window assembly to a building without requiring additional support brackets and frames.

It is still a further object of the present invention to provide a prefabricated roof structure for bay and bow type window assemblies that is lightweight and easy to install that has a structural integrity and durability which adds to the support and securement of the window assembly to the wall of a building.

BRIEF DESCRIPTION OF THE DRAWINGS

The foregoing objects and other features of the invention will become more readily apparent and may be understood by referring to the following detailed description of an illustrative embodiment of the prefabricated roof structure for bay and bow type window assemblies, taken in conjuction with drawings; in which.

FIGS. *2a–2e* illustrate elevational cross-sectional views of the roof structure of FIG. 1 along lines A—A, where each of FIGS. *2a–2e* illustrate a different embodiment of the roof structure of the present invention.

DETAILED DESCRIPTION OF THE PREFERRED EMBODIMENTS

Figure 1:
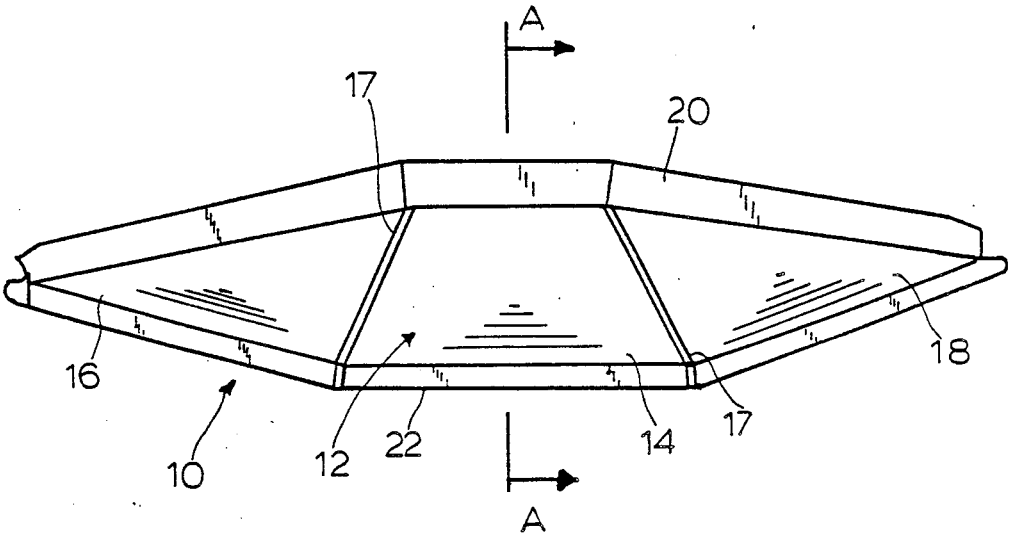
FIG. 1 illustrates a perspective view of a roof structure pursuant to the present invention.
Figure 2A:
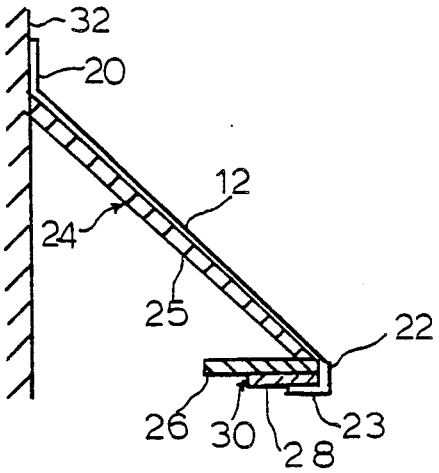
Figure 2B:
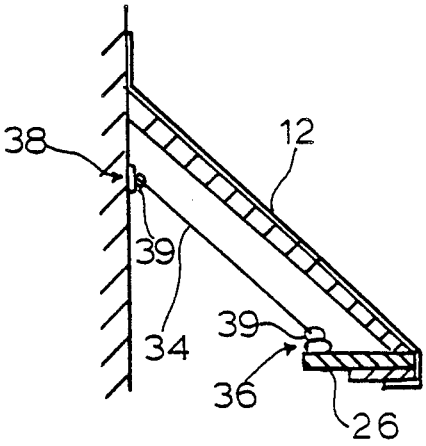
Figure 2C:
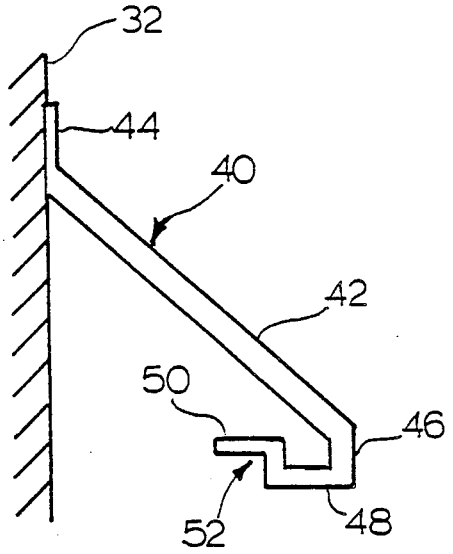
Figure 2D:
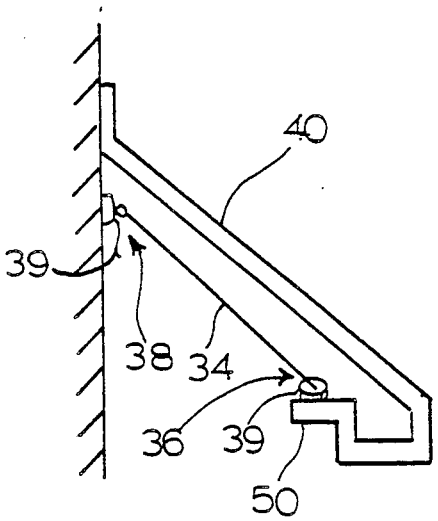
Figure 2E:
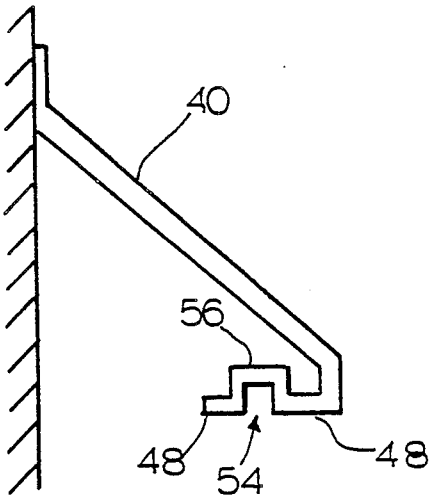

Referring now in specific detail to the drawings, in which identical reference numerals identify similar or identical elements throughout the several views, FIG. 1 shows prefabricated roof structure 10 according to the present invention. Roof structure 10 is manufactured as a single piece construction which is transported to a job site for installation on bay or bow type windows, or may be sold intact as a retail item for home installation. As is known, bay windows generally comprise a center panel or panels of windows which are parallel to the wall in which the window assembly is mounted and are provided with side or flanker panels extending away from the center panel or panels in identical obtuse angles. The roof which fits over a bay window is constructed in an identical angular relation corresponding to the window panels. Bow windows are similar except that the center panel is generally comprised of at least two panels to form a rounded or semicircular shape to the window assemby. The roof structure that fits on a bow window assembly is provided with panels which are equal in number to the window panels and arranged in the same angular relationship as the window panels. The drawing figures show a roof structure for a bay window; however, it is understood that the principle of the present invention is identical for bow windows as well.

Roof structure 10, as shown in FIG. 1, comprises a center panel 14 with side panels 16 and 18 which angle away from center panel 14 at identical obtuse angles from center panel 14 at junctures 17. A flashing or upper flange 20 is provided for securing the upper part of the roof structure to the wall of a building to which the window assembly (not shown) is to be installed. The lower edge of roof structure 10 bends over to form facing 22 and lower lip 23, as best seen in FIG. *2a*.

In the preferred embodiment, as best seen in FIG. *2a*, roof structure 10 comprises a preformed cap 12 which is fit over a rigid infrastructure or frame 24. Frame 24 is preferably constructed of wood or similar rigid material and comprises body portion 25, support ledge 26, and beam 28. Cap 12, preferably constructed of a vinyl or other plastic material, or from a thin sheet of metal such as copper or steel, preferably comprises a single piece which fits over and encloses frame 24 in a weather-tight manner. Cap 12 is provided with flange 20 which is secured to wall 32 of the building on which the bay window or bow window unit is to be installed.

After the window assembly is installed, the roof structure 10 is fit over the window assembly, and the roof structure is secured to the window assembly at support ledge 26. The window assembly contacts and engages the support ledge along shoulder 30 of beam 28 and the window assembly is fastened to support ledge 26 as the window assembly rests against shoulder 30. Flange 20 is then secured to wall 32 in a conventional manner, such as by nails or screws through holes provided in the flashing (not shown).

The basic construction of roof 10 is such that cap 12 is fit over frame 24 and secured in a conventional manner, such as by adhesives, nails, screws, or by similar means. The components of frame 24 are likewise secured to each other by adhesives, screws, or nails, or similar means.

FIG. *2b* shows an alternate embodiment of roof structure 10 as shown in FIG. *2a*. As seen in FIG. *2b*, roof structure 10 is provided with a tensioning means for securely anchoring roof structure 10 to wall 32, which adds structural stability to the entire window assembly. Tensioning means 34 comprises a guy wire, cable, or the like, or metal bracket as described in detail below, and is secured to roof structure 10 at connection point 36 on support ledge 26. Connection point 36 may be made in a conventional manner, such as by screws or bolts, or preferably, by securement to eye bolt 39. When roof structure 10 is secured on the window assembly, roof structure 10 is secured to the window and wall in the manner described above, and a second end of tensioning means 34 is secured to wall 32 at connection point 38, which preferably comprises eye bolt 39. Tensioning means 34 is then tightened to firmly secure roof structure 10, and consequently the window assembly, in place. Several tensioning means may be provided at various locations along support ledge 26, and it is also contemplated that tensioning means 34 comprises a single cable or guy wire which may run through several connection points 36 and 38 provided at several locations in the roof structure 10 and wall 32, so that tensioning may occur at one location to securely mount and anchor the entire roof assembly in place.

FIG. *2c* shows an alternate embodiment of the roof structure according to the present invention. In this embodiment, roof structure 40 is molded or formed from a single piece or rigid material, preferably comprising reinforced plastic or rolled sheet metal, such as stainless or painted steel, or copper. In this embodiment, roof structure 40 is sufficiently thick to support and secure a window assembly as described above. Roof structure 40 comprises a body portion 42 comprising panels, having an upper flange 44 and a facing 46. A soffit 48 is formed at the lower edge of roof structure 40 and bends to form a projection 50 which is parallel to soffit 48 through perpendicular shoulder 52. Roof structure 40 is mounted on a window assembly and engages shoulder 52, so that the projection 50 is secured to the window at shoulder 52. Flange 44 is secured to a wall 32 in a manner similar to that described for FIG. *2a* above.

FIG. *2d* shows an alternate construction of a roof structure 40 of FIG. *2c*, in which a tensioning means 34 is provided and secured to projection 50 at connection point 36. The opposite end of tensioning means 34 is secured to wall 32 at connection point 38, much in a manner similar to that described above in regards to FIG. *2b*.

FIG. *2e* shows a further embodiment of roof structure 40 as seen in FIG. *2c*. In FIG. *2e*, roof structure 40 is provided with a notch or channel 54 which is formed by a series of bends in soffit 48. The upper edge of a window assembly fits in channel 54 and is secured thereto. A tensioning means may be provided at connection point 56 as indicated in FIG. *2d*.

As stated above, the roof structure may be inverted to serve as the bottom cover and support to provide a finished appearance and eliminate the need for additional brackets and frames. The bottom structure supports and secures the window platform so that the window assembly may be mounted thereon, without requiring brackets or braces in addition to the bottom support.

Figure 3:
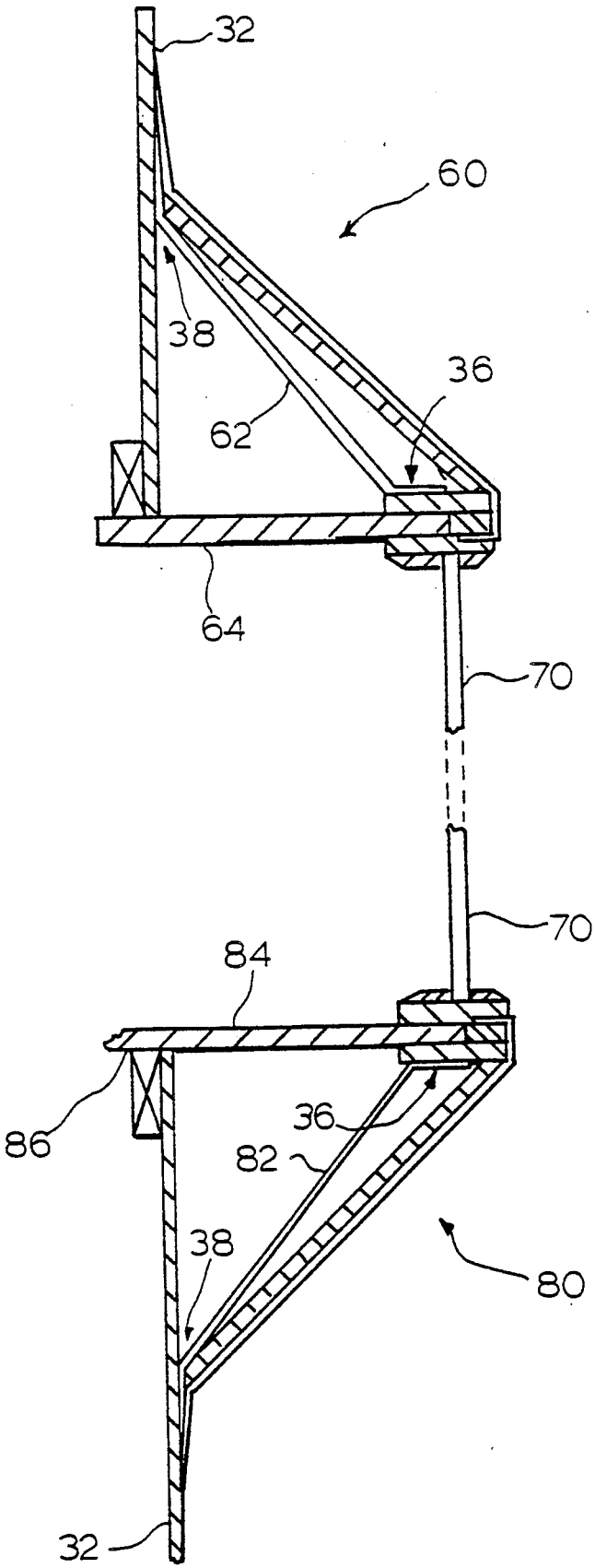
FIG. 3 illustrates an elevational cross-sectional view of the roof structure and inverted structure for the bottom support and cover for an installed bay window similar to the views shown in FIGS. *2a–2e*.

As best seen in FIG. 3, the structure of the present invention may be used as a roof structure 60 as well as a bottom support 80. Roof structure 60 is similar to that described above except that a tensioning or support bar 62 is provided to secure and anchor the structure to the window and wall. A similar bar 82 is provided on the bottom support.

In use, window platform 84 is positioned on sill plate 86 and fastened and leveled. Bottom support 80 is then positioned as shown and fastened to platform 84, which then is leveled again. Bar 82 is secured to the support ledge of the frame as indicated above at connection point 36 by screws, nails or the like, and the opposite end of the bar is positioned behind the flashing 88 and secured to the wall 32 with the flashing by nails, screws or the like. Window assembly 70 is then positioned on platform 84 and secured thereto. Bottom support 80 rigidly secures and supports the window assembly 70. Roof structure 60 is mounted as indicated above, but with support bar 62 having its one and secured behind flashing 66 and secured to wall 32 with flashing 66. The other end of bar 62 is of course secured to the support ledge at connection point 36.

While the invention has been particularly shown and described with reference to the preferred embodiments, it will be understood by those skilled in the art that various changes in form and detail may be made therein without departing from the spirit and scope of the invention. Accordingly, modifications, and/or changes, such as inverting the roof structure and support to form the base unit of a bay or bow window unit, may be provided as desired, and are considered to be within the scope of the invention.

What is claimed is:

1. A prefabricated roof structure for bay and bow type windows, comprising:

a rigid frame having a body portion, a support ledge having means for securing a window thereto and a support beam, said support ledge positioned at an angle to said body portion, said support beam positioned parallel and adjacent to said support ledge so as to form a shoulder portion, said body portion including a plurality of panels corresponding to a number of window panels forming said bay type window; and a cap in contact with said panels of said frame for covering said frame, said cap having an upper flange and an inturned lower edge portion;

wherein said cap overlies said frame such that the inturned lower edge portion is secured to said support beam of said frame and said upper flange of said cap is positioned at an angle to said body portion of said frame for securement to a wall structure.

2. A roof structure according to claim 1, wherein said body portion and said support ledge of said frame form an acute angle.

3. A roof structure according to claim 1, wherein said ledge is provided with a stepped portion for aligning a window, said stepped portion including means for securing a window thereto.

4. A roof structure according to claim 1, wherein said ledge is provided with a notched portion for positioning a window therewithin, said notched portion including means for securing said window thereto.

* * * * *